United States Patent [19]

Fujino

[11] 4,224,010

[45] Sep. 23, 1980

[54] MULTISTAGE TURBOCOMPRESSOR WITH DIAGONAL-FLOW IMPELLERS

[75] Inventor: Yoshikazu Fujino, Kobe, Japan

[73] Assignee: Kawasaki Jukogyo Kabushiki Kaisha, Kobe, Japan

[21] Appl. No.: 16,735

[22] Filed: Mar. 2, 1979

[30] Foreign Application Priority Data

Mar. 7, 1978 [JP] Japan ..... 53-26119

[51] Int. Cl.[3] ..... F04D 17/12

[52] U.S. Cl. ..... 415/199.2

[58] Field of Search ..... 415/199.1, 199.2, 199.6, 415/199.3

[56] References Cited

U.S. PATENT DOCUMENTS

| | | | |
|---|---|---|---|
| 1,050,419 | 1/1913 | Banner | 415/199.2 |
| 1,902,406 | 3/1933 | Inokuty et al. | 415/199.2 X |
| 2,397,816 | 4/1946 | Sorensen | 415/199.1 X |
| 2,405,284 | 8/1946 | Birmann | 415/199.6 X |
| 2,474,077 | 6/1949 | Trumpler | 415/199.2 |
| 3,927,763 | 12/1975 | Strub | 415/199.2 X |

*Primary Examiner*—Leonard E. Smith

*Attorney, Agent, or Firm*—Haseltine, Lake & Waters

[57] ABSTRACT

The majority of the impellers of a multistage turbocompressor are diagonal-flow or "mixed-flow" type impellers with exit flow angles which are increased from the initial stage impellers toward the final stage impellers, whereby the specific speed of each impeller falls with the optimal range for that impeller.

8 Claims, 3 Drawing Figures

MULTISTAGE TURBOCOMPRESSOR WITH DIAGONAL-FLOW IMPELLERS

BACKGROUND OF THE INVENTION

This invention relates generally to multistage turbocompressors of the type having a plurality of impellers or fan wheels mounted on a single rotating shaft and operating to compress a gaseous fluid such as air or a gas. More specifically, the invention relates to a multistage turbocompressor of the above stated character in which all or most of the impellers are of the diagonal-flow or "mixed-flow" type with exit flow angles increased from the impellers near the suction end toward those near the discharge end thereby to cause the specific (rotational) speed of each impeller to be within its optimal range.

In general, a gaseous fluid such as air or a gas possesses compressibility, and, therefore, when the gaseous fluid is compressed for the purpose of raising its pressure, its volume decreases according to Boyle's law (also known as Mariotte's law) as is well known. For a 4-stage compressor to suck in air and produce a discharge or delivery pressure of 7 kg.f/cm$^2$.G, it is necessary that the pressure ratio (i.e., the ratio of the absolute discharge and suction pressures) of each stage be selected at a value of the order of 1.7, and the volumetric flow rate of the gaseous fluid sucked into a fan wheel or impeller is reduced approximately 60 percent upon reaching the entrance of the succeeding stage.

For the purpose of obtaining a discharge or delivery pressure of 7 kg.f/cm$^2$.G with 3-stage compression, it is necessary to select a pressure ratio of approximately 2 for each stage. In this case, the volumetric flow rate at the entrance of the impeller of the succeeding stage is decreased to approximately 50 percent of that of the preceding stage. Thus, as the pressure ratio per stage increases, the rate of decrease of the volumetric flow rate of the gaseous fluid sucked into the impeller of a succeeding stage increases.

On one hand, in order for the impeller of each stage to exhibit high efficiency, it is required that the specific (rotational) speed $N_s$ expressed by the following equation be within an optimum range for each stage.

$$N_s = N \cdot Q^{\frac{1}{2}} / H_{ad}^{\frac{3}{4}}, \quad (1)$$

where: N is the impeller rotational speed (r.p.m.); Q is the volumetric flow rate (m$^3$/min.) of each stage; and $H_{ad}$ is the adiabatic head (m.) of each stage. This specific speed $N_s$ is derived from the fluid mechanical law of similarity of turboblowers and compressors. It is a quantity having an important relation to the performance of the turbomachine and is an essential factor also in the selection of the type of the impellers.

Among the types of impellers, the common types are the centrifugal type, the diagonal-flow or "mixed-flow" type, and the axial-flow or propeller type. For each type, there is an optimum specific speed, and impellers of equal specific speed $N_s$ are geometrically similar impellers irrespective of their sizes and their rotational speeds. Furthermore, the optimum value of the specific speed $N_s$ has the characteristic of increasing with increasing width of the impeller blades in the centrifugal type and, further, with transformation into the diagonal-flow type.

Heretofore, in multistage turbocompressors, the impellers of the multiple stages have been of the axial-flow type, the centrifugal type, or a combination of the two types. For example, in one common type, a plurality of centrifugal type impellers are successively fixed in tandem on a single rotating shaft, and all impellers have the same outer diameter. When the outer diameters of the impellers are thus made all equal, the specific speed $N_s$ decreases in proportion to $\sqrt{Q}$ toward the rear stages. Accordingly, the shapes of the impellers are so designed that, on the low-pressure side including the initial stage, the ratio of the inner and outer diameters of each impeller is large, and the blade width is wide, while, on the high-pressure side, the ratio of the inner and outer diameters becomes smaller and the blade width becomes narrower while the blade flow path becomes longer as the final stage is approached.

However, the range of optimal specific speed wherein a centrifugal type impeller can exhibit high efficiency is not very wide. For this reason, in general, the specific speed $N_s$ of only the impellers of one part become optimal, and decrease in the efficiencies of the other impellers cannot be avoided. This has been the cause of lowering of the efficiency of the compressor as a whole.

In one example of a known multistage turbocompressor which has been designed to overcome this problem as much as possible, a plurality of impellers are successively fixed in tandem on a single rotating shaft, as in the above described example, but the initial-stage impeller is a doulbe-suction impeller which sucks gaseous fluid at opposite axial ends. It is contemplated by this arrangement to increase the capacity of the initial-stage impeller, to make the range of the specific speeds $N_s$ of the other impellers as narrow as possible, and to increase the efficiency of the compressor as a whole. In this case, however, the flow path from the double-suction impeller of the initial stage to the entrance of the impeller of the succeeding stage becomes complicated and gives rise to problems in the construction of the compressor casing.

In still another example of a known multistage turbocompressor, the achievement of the same object as in the preceding example is comtemplated by providing an initial-stage impeller having a wide, unobstructed entrance at the front end of the rotating shaft, which, at its front end part is a cantilever shaft. Thus, the capacity of the initial-stage impeller is made large. The optimal specific speed $N_s$ thereof is made high, and the range of the specific speeds $N_s$ of the impellers of the succeeding stages is made narrow. In this case, however, since a front or inboard bearing is required between the impeller of the initial stage and that of the succeeding second stage, the compressor casing is divided at the part between the initial stage and the remainder of the stages, which gives rise to complications in the construction. Furthermore, the diameter of the rotating shaft at the front bearing must be made greater for the sake of strength, whereby there arise problems such as severe design conditions due to the resulting increase in the shaft circumferential velocity.

The overcoming of these problems was evidently contemplated in a further example of a known multistage turbocompressor, in which a plurality of impellers, which are fixed successively in tandem on one rotating shaft, are divided into three impeller groups seuqentially from the front or suction end to the rear or discharge end. The outer diameters of the impellers in each group are the same, but the outer diameters of the impellers of the three groups are successively decreased from the front end to the rear end, and the specific speed $N_s$ of each impeller is made to approach as close to the optimum value as possible. In this case, while the efficiencies of all impellers can be made high, since the outer diameters of the impellers of the rearward groups are small, their circumferential velocities are low, and the pressure head per stage decreases as the second power of the circumferential velocity.

That is, the pressure ratios of the impellers of the rearward stages decrease, and the compressing capacity of the compressor as a whole decreases. Alternatively, in order to obtain the same compressing capacity, it is necessary to increase the number of stages beyond that ordinarily used in the above described known compressore. Furthermore, since the centrifugal stress produced in an impeller also decreases as the square of th circumferential velocity, the centrifugal stress imparted to the impellers of the rear stages becomes much lower than the allowable stress of the impeller material, whereby the efficiency of material utilization drops remarkably.

As described above, in the case where all of the impellers of a known multistage turbocompressor are of the centrifugal type, the efficiency of the compressor as a whole decreases, and attempts to prevent this decrease in the efficiency have unavoidably entailed problems such as complication of construction and necessity of increasing the number of stages.

SUMMARY OF THE INVENTION

It is an object of this invention to provide a multistage turbocompressor in which the above described problems encountered in the prior art are overcome by a structural organization wherein all or the majority of the impellers are diagonal-flow impellers with exit flow angles less than 90 degrees, which are increased from those of the impellers nearest the suction end of the turbocompressor toward those of the impellers at the discharge end thereby causing the specific speed of each impeller to be of optimal value.

The nature, utility, and further features of this invention will become more clearly apparent from the following detailed description with respect to a preferred embodiment of the invention when read in conjunction with the accompanying drawing which is briefly described below, and throughout which like parts are designated by like reference numerals.

DETAILED DESCRIPTION

Figure 1:
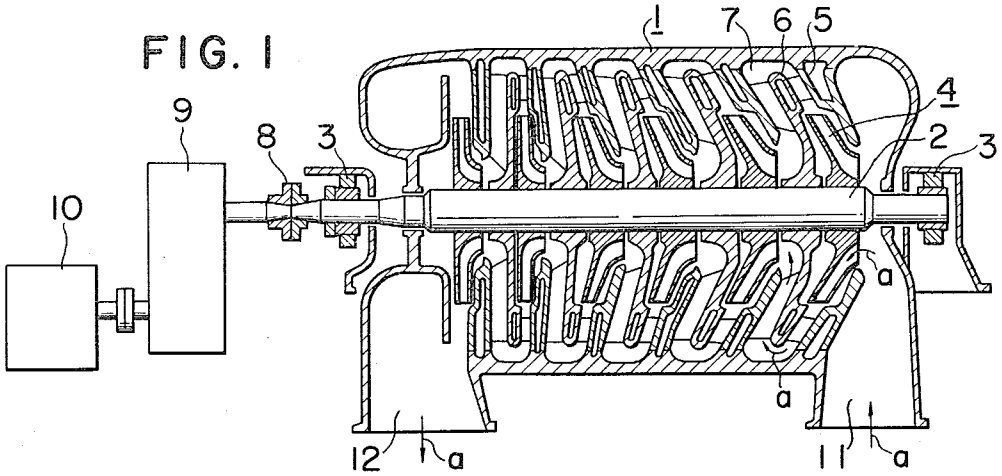
FIG. 1 is side view in longitudinal section showing one example of the multistage turbocompressor according to this invention.

Referring first to FIG. 1, the example of the multistage turbocompressor according to this invention illustrated therein has a casing 1 constituting the main structure of the compressor and having suction and discharge ends, a rotating shaft 2 rotatably supported on bearings 3, 3 fixed to and supported by the casing 1 at the two ends thereof, and a plurality of impellers 4, described hereinafter, which are fixedly mounted in successive tandem arrangement on the shaft 2. The flow paths 7 of the gas between adjacent stages, that is, between the exit parts of preceding stages and the entrance parts of respective succeeding stages, are formed by guide plates 5 and 6. The gas to be compressed is drawn in through a suction port 11 formed integrally with the casing 1 at its suction end, and the compressed gas is discharged through a discharge port 12 formed integrally with the casing 1 at its discharge end.

One end of the rotating shaft 2 is coupled by a coupling 8 to a speed-increasing device 9, which is coupled to and driven by a driving power machine 10 such as a turbine, an engine, or an electric motor. Depending on the relation between the rotational speeds of the driving power machine 10 and of the compressor, the driving power machine 10 may be directly coupled to the shaft 2 without the use of a speed-increasing device 9.

The general construction of the multistage turbocompressor of this invention as described above is similar to that of a conventional multistage turbocompressor. However, the design of the impellers 4 according to this invention, as described hereinafter, is uniquely different from known designs and affords achievement of the objects of the invention.

As summarized hereinabove and as described more fully hereinafter, most of the impellers of the turbocompressor of the invention are of the diagonal-flow type, known also as the "mixed-flow" type. A diagonal- flow impeller is generally defined as an impeller which has a gas entrance at which the gas being impelled flows in the axial direction and an exit at which the gas flows out in a direction diagonal to or inclined to the axial direction.

Figure 3:
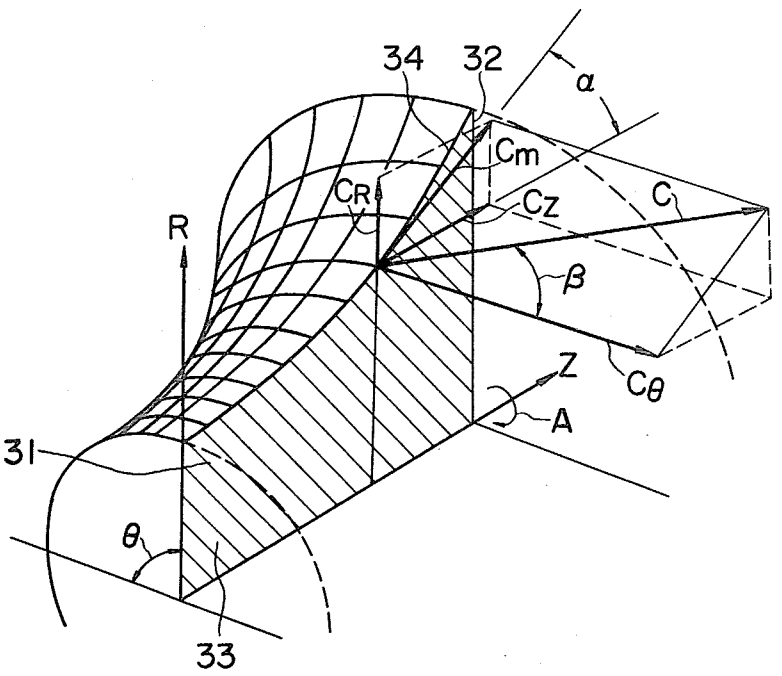
FIG. 3 is a diagrammatic perspective view for a description of the flow of a gas within an impeller.

More specifically, in FIG. 3, it will be assumed that a meridional plane 33 exists in the gas flow path through an impeller from its entrance 31 to its exit 32, the impeller being rotating around an axis Z in the direction of arrow A. In this case, at a streamline 34 within the meridional plane, the exit velocity C of the gas flowing out from the impeller has not only a radial component $C_R$ and a tangential component $C_\theta$as in a centrifugal type impeller but also an axial component $C_Z$. Accordingly, when the exit flow angle of the exit 32 of the impeller, that is, the angle $\alpha$ between the velocity component $C_m$ along the above mentioned streamline and the axial direction Z, becomes zero degrees, the impeller becomes one of the axial-flow type, while when the angle $\alpha$ becomes 90 degrees, the impeller becomes one of centrifugal type. For this reason, an impeller exhibiting characteristics of a diagonal-flow type, in actual practice, has an exit flow angle $\alpha$ in the range of 20 to 70 degrees.

Such an impeller is suitable for use for characteristics intermediate between those of the centrifugal type and those of the axial-flow type, for example, for use in an intermediate specific speed region. The smaller the exit flow angle $\alpha$ is, the greater is the specific speed $N_s$, and the higher is the efficiency. Thus, in a diagonal-flow impeller, an optimal specific speed $N_s$ which is greater than that of a centrifugal type impeller of the same outer diameter can be obtained. As is apparent from Eq. (1), the volumetric flow rate Q is proportional to the square of the specific speed $N_s$. Therefore, a diagonal-flow impeller, which has a high optimal specific speed $N_s$, can process a greater flow rate, in comparison with that of a centrifugal impeller of the same outer diameter, proportionally to the square of the ratio of the optimal specific speeds $N_s$ of the two types of impellers.

By utilizing the characteristics of this nature of diagonal-type impellers, it is possible to provide a multistage turbocompressor wherein a plurality of impellers having substantially the same diameter but of respectively different suction volumetric flow rates and, moreover, operating at their respective optimum specific speeds $N_s$ are mounted on a single rotating shaft.

Figure 2:
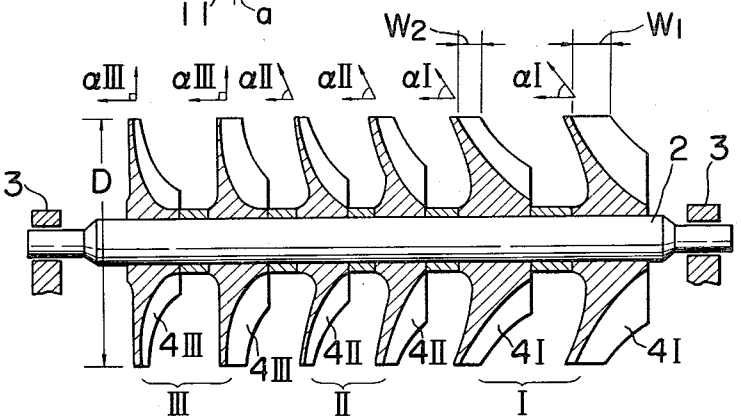
FIG. 2 is a relatively enlarged side view in longitudinal section showing an essential part of the compressor shown in FIG. 1.

Accordingly, in the example illustrated in FIG. 1 of the multistage turbocompressor according to this invention, the plurality of impellers 4, as shown in FIG. 2, have the same outer diameter D and, moreover, are divided into three impeller groups I, II, and III, the three groups I, II, and III having two impellers each, that is impellers 4I, 4II, and 4III, respectively. The important feature of these impellers is that the exit flow angle $\alpha$ of impellers of an upstream stage is less than the angle $\alpha$ of the impellers of a downstream stage. Accordingly, the most upstream impellers 4I of the impeller group I have a small exit flow angle $\alpha$I; the impellers 4II of the intermediate stage impeller group II have a greater exit flow angle $\alpha$II; and the impellers 4III of the most downstream stage impeller group III have a still greater exit flow angle $\alpha$III, being centrigfugal-type impellers in this example. That is, the relationships between these exit flow angles is as follows.

$$\alpha I < \alpha II < \alpha III \quad (2)$$

For this reason, the optimal specific speeds $N_s$, as impeller characteristics, become successively smaller in the sequence of groups I, II, and III.

Furthermore, even with the same exit flow angle $\alpha$, the specific speed $N_s$ can be varied to a certain extent within the range of optimal specific speed by changing the impeller blade width. Thus, in the instant example, the exit flow angle $\alpha$ is made equal in any one impeller group, and only blade width W is varied thereby to change the specific speed $N_s$. More specifically, the blade width W1 of the upstream impeller 4I of the impeller group I is made greater than the blade width W2 of the downstream impeller 4I of the same group I, whereby the upstream impeller has a greater specific speed than the downstream impeller. With respect to the other groups II and III, the same relation between the blade widths of the impellers of the same group exists.

In the case where variation of only the blade width will give rise to a departure from the range of optimal specific speed, it is also possible to vary successively the exit flow angles of all of the impellers 4 on the single rotating shaft 2 thereby to cause the specific speed $N_s$ of each impeller to fall with the range for maximum efficiency.

In the case where the required compression ratio of the compressor of the instant example is 20, for example, the values of the exit flow angles $\alpha$I, $\alpha$II, and $\alpha$III of the impeller groups I, II, and III are suitably set as $\alpha I = 30$ degrees, $\alpha II = 60$ degrees, and $\alpha III = 90$ degrees, whereby the specific speed $N_s$ of each of the impellers 4 (4I, 4II, and 4III) will be of an optimal value.

In the multistage turbocompressor of the above described structural organization, the gaseous fluid a such as air or a gas is drawn in through the suction port 11 and into the impeller group I of the first stage, where it is compressed, and its pressure is raised. The gaseous fluid thus compressed passes through the flow path 7 formed by the guide plates 5 and 6 and thus introduced into the impeller group II of the second stage, where it is further compressed, and its pressure is further increased. The raising of the gaseous fluid pressure is repeated in this manner until the fluid is discharged at the required pressure from the impeller group III of the final stage through the discharge port 12.

In the above described process of compression and pressure elevating, the compression efficiency is high since the specific speed $N_s$ of each of the impellers 4 (4I, 4II, and 4III) is within its optimal range. As is known, the temperature of the gaseous fluid a rises when the fluid a is compressed. In some cases it may be feasible and economical to cool the fluid a to a suitable temperature by means of a cooling system in an intermediate stage thereby to cause the compression process to approach an isothermal variation and thereby to elevate the efficiency.

While the above described embodiment of the invention illustrates the case wherein the plurality of impellers 4 are divided into three impeller groups I, II, and III, various other divisions and arrangements are also possible according to this invention. For example, only two groups II and III or four or more groups may be used. Furthermore, there may be one impeller in each group.

According to this invention, as described above, there is provided a multistage turbocompressor of high efficiency and high pressure raising capability in which the plurality of impellers 4 on the single rotating shaft 2 are made to have the same diameter D thereby to equalize at the same level the magnitudes of centrifugal force produced in the impellers 4, whereby the efficiency of utilization of the impeller material is elevated, and, at the same time, and the delivery pressure required of the compressor can be attained with a smaller number of impellers.

Furthermore, the outer diameter D of the impellers 4 shown in FIG. 2 can be made equal to the outer diameter of the impeller of the final stage in a known multistage turbocompressor having only centrifugal type impellers as, for example, a turbocompressor having centrifugal impellers having progressively diminishing outer diameters from the suction end to the discharge end as described hereinbefore, that is, equal to the outer diameter of the smallest impeller in a conventional turbocompressor. For this reason, together with the above mentioned reduction in number of stages, reducing of the size as well as the weight of the compressor can be achieved. In addition, since all impellers can be of the single-suction type, problems and complications encountered in relation to double-suction impellers are avoided.

Still another advantage of the turbocompressor of this invention is that, since the rotating shaft does not have a cantilever end, the problem of increased shaft diameter for strength is avoided. A further advantage is that, since the bending angle of the streamlines within the meridional plane from the entrance to the exit of a diagonal-flow impeller is less than the 90 degrees of centrifugal type impellers, the loss due to bending of flow direction is smaller, and the fluid mechanical efficiency is high. Moreover, since the specific speed $N_s$ of each impeller can be so selected that it is optimal in accordance with the suction volumetric flow rate Q, the compressor efficiency is further improved.

What I claim is:

1. In a multistage turbocompressor which has a casing having suction and discharge ends, a rotating shaft passing through the casing, and a plurality of impellers fixedly mounted on the shaft in successive tandem arrangement, and which operates to draw a gas in through the suction end, to compress the gas, and to discharge the gas out through the discharge end, the improvement wherein at least some of the impellers are diagonal-flow impellers with exit flow angles less than 90 degrees, and, when the impellers are considered to be divided in a plurality of successively tandem groups each having at least one impeller, the exit flow angle of an impeller of any group nearer the suction end is made less than the exit flow angle of an impeller of a group more remote from the suction end than the first named group thereby to cause the specific speed of each impeller to be of optimal value, the exit flow angle of an impeller being the angle between the velocity component along a streamline within an imaginary meridional plane extending from the flow entrance to the flow exit of that impeller and passing through the axis of rotation thereof and the axis of rotation.

2. The improvement in a multistage turbocompressor as set forth in claim 1 wherein the impellers have the same outer diameter.

3. The improvement in a multistage turbocompressor as set forth in claim 1 or 2 wherein each of said groups has a plurality of impellers having the same exit flow angle.

4. The improvement in a multistage turbocompressor as set forth in claim 1 wherein the impellers have blades of blade widths which are varied among the impellers thereby to cause, in concert with the differences in the exit flow angles, the specific speed of each impeller to be of optimal value.

5. The improvement in a multistage turbocompressor as set forth in claim 1 wherein the exit flow angles of the impellers are within the range of 20 to 90 degrees.

6. The improvement in a multistage turbocompressor as set forth in claim 2 wherein the exit flow angles of the impellers are within the range of 20 to 90 degrees.

7. The improvement in a multistage turbocompressor as set forth in claim 3 wherein the exit flow angles of the impellers are within the range of 20 to 90 degrees.

8. The improvement in a multistage turbocompressor as set forth in claim 4 wherein the exit flow angles of the impellers are within the range of 20 to 90 degrees.

* * * * *

REEXAMINATION CERTIFICATE (1233rd)

United States Patent [19] [11] B1 4,224,010

Fujino [45] Certificate Issued Apr. 3, 1990

[54] MULTISTAGE TURBOCOMPRESSOR WITH DIAGONAL-FLOW IMPELLERS

[75] Inventor: Yoshikazu Fujino, Kobe, Japan

[73] Assignee: Kawasaki Jukogyo Kabushiki Kaisha, Kobe, Japan

Reexamination Request:
No. 90/001,738, Mar. 29, 1989

Reexamination Certificate for:

| | |
|---|---|
| Patent No.: | **4,224,010** |
| Issued: | **Sep. 23, 1980** |
| Appl. No.: | **16,735** |
| Filed: | **Mar. 2, 1979** |

[30] Foreign Application Priority Data

Mar. 7, 1978 [JP] Japan ..... 53-26119

[51] Int. Cl.[4] ..... F04D 17/12
[52] U.S. Cl. ..... 415/199.2
[58] Field of Search ..... 415/199.2, 199.1, 199.3, 415/199.6; 416/198 A, 198 R

[56] References Cited

U.S. PATENT DOCUMENTS 1,050,419 1/1913 Banner ..... 415/199.2

FOREIGN PATENT DOCUMENTS 1813335 7/1969 Fed. Rep. of Germany .
530662 12/1921 France ..... 415/199.3
315988 10/1956 Switzerland .
689353 3/1953 United Kingdom .
992651 5/1965 United Kingdom .

OTHER PUBLICATIONS

Die Kreiselpumpen etc., Carl Pfeiderer, Berlin, 1955, pp. 472, 477–478.
GHH Untersuchungen, etc., GHH Technische Berichte, Jan. 1969, pp. 2–15.
Stromungsmaschinen, Pfleiderer et al., Berlin 1972, p. 80.
Axialkompressoren etc., Eckert, Berlin 1953, Forward and FIG. 73.
Sangyo Kikai, vol. 151, 538 pp. 27–32, 82 and prints.
Mistubishi Jukyo GIHO, vol. 12, No. 3, 538, pp. 320–322.
Kuki Kikai Kogaku Binran 530, pp. 376, 377, 714.
Principles of Turbomachinery–Shepherd 1956–pp. 34–39, MacMillan Co.
Fluid Mechanics Thermodynamics of Turbomachinery, 3rd Edition–Dixon, 1978–pp. 12–14, Pergamon Press.
Fluid Mechanics, Acoustics and Design of Turbomachinery, part II, National Ernatics Space Administration, 1970, pp. 543–556.

*Primary Examiner*—Leonard E. Smith

[57] ABSTRACT

The majority of the impellers of a multistage turbocompressor are diagonal-flow or "mixed-flow" type impellers with exit flow angles which are increased from the initial stage impellers toward the final stage impellers, whereby the specific speed of each impeller falls with the optimal range for that impeller.

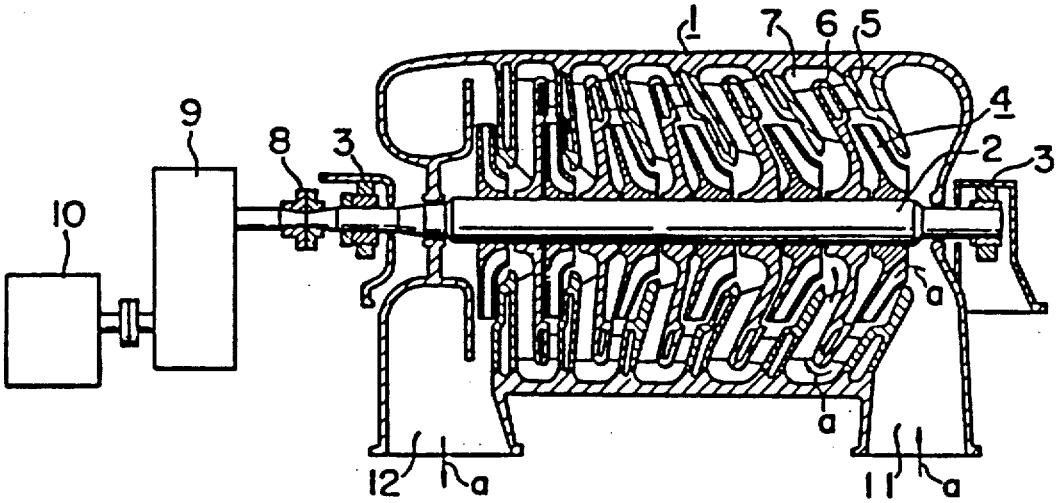

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–8 are cancelled.

* * * * *